US006280296B1

(12) United States Patent
Sato et al.

(10) Patent No.: US 6,280,296 B1
(45) Date of Patent: Aug. 28, 2001

(54) SURFACE POLISHING METHOD AND APPARATUS WHEREIN AXIS OF AUTOROTATION OF WORKPIECE IS REVOLVED ABOUT AN AXIS WITHIN CIRCUMSCRIBED CIRCLE OF THE WORKPIECE

(75) Inventors: Makoto Sato, Nagoya; Yukio Yamaguchi, Ichinomiya; Noriyuki Tomikawa, Nagoya, all of (JP)

(73) Assignee: Noritake Co., Ltd., Nagoya (JP)

( * ) Notice: Subject to any disclaimer, the term of this patent is extended or adjusted under 35 U.S.C. 154(b) by 0 days.

(21) Appl. No.: 09/450,775

(22) Filed: Nov. 30, 1999

(30) Foreign Application Priority Data

Dec. 2, 1998 (JP) ..... 10-342847

(51) Int. Cl.[7] ..... B24B 1/00

(52) U.S. Cl. ..... 451/41; 451/63; 451/270; 451/271; 451/287; 451/291

(58) Field of Search ..... 451/41, 63, 270, 451/271, 287, 291

(56) References Cited

U.S. PATENT DOCUMENTS 3,708,921 * 1/1973 Cronkhite et al. ..... 451/41
4,773,185 * 9/1988 Taira ..... 451/269
4,805,348 * 2/1989 Arai et al. ..... 451/269
5,516,328 * 5/1996 Kawada ..... 451/259
6,042,459 * 3/2000 Honda ..... 451/274

FOREIGN PATENT DOCUMENTS 6-63861 3/1994 (JP) .
8-127 1/1996 (JP) .
9-155728 6/1997 (JP) .

* cited by examiner

*Primary Examiner*—Joseph J. Hail, III
*Assistant Examiner*—Shantese McDonald
(74) *Attorney, Agent, or Firm*—Oliff & Berridge, PLC

(57) ABSTRACT

Surface polishing system adapted to polish, lap or grind a surface of a workpiece in a plane such that the workpiece is held in sliding contact with a polishing face of a rotating polishing plate, wherein the workpiece is rotated by a work rotating device about an autorotation axis thereof which is parallel to an axis of rotation of the polishing plate and which lies within the surface of the workpiece, and the autorotation axis of the workpiece is revolved by a work revolving device about a revolving axis which is parallel to the axis of rotation of the polishing plate and which lies within a circumscribed circle of the surface of the workpiece.

20 Claims, 6 Drawing Sheets

SURFACE POLISHING METHOD AND APPARATUS WHEREIN AXIS OF AUTOROTATION OF WORKPIECE IS REVOLVED ABOUT AN AXIS WITHIN CIRCUMSCRIBED CIRCLE OF THE WORKPIECE

This application is based on Japanese Patent Application No. 10-342847, the content of which is incorporated hereinto by reference.

BACKGROUND OF THE INVENTION

1. Field of the Invention

The present invention relates to surface polishing method and apparatus using a polishing plate or wheel which has a polishing face for polishing, lapping or grinding a surface of the workpiece in a plane.

2. Discussion of the Related Art

A surface polishing method and an apparatus for practicing the method are known for polishing, lapping or grinding a surface of the workpiece in a plane, such that the workpiece is held in sliding contact with a polishing face of a rotating polishing or lapping plate or wheel while the workpiece is rotated about its axis parallel to the axis of rotation of the polishing plate. The polishing face has a polishing surface, which has abrasive grains fixed or bonded thereto or on which loose or free abrasive grains are present. In this type of surface polishing method and apparatus, there is a general tendency that the polishing distance over which the abrasive grains are moved relative to the workpiece surface is different at different radial positions of the workpiece, in particular, at the peripheral and central portions (radially outer and inner portions) of the workpiece. This difference of the polishing distances at the different local radial positions of the workpiece surface increases with an increase in the size of the workpiece surface to be polished, lapped or ground, and is relatively large when the diameter of the circular workpiece surface or the length of a side of the rectangular workpiece surface is several tens of centimeters or more. The difference of the polishing distances causes a difference in the local polishing efficiency of the workpiece surface, which tends to cause the central portion of the polished workpiece surface to be raised or upwardly convexed, resulting in deteriorated flatness of the polished workpiece surface.

There is proposed another type of surface polishing method and apparatus wherein a plurality of workpieces are held on the work holding surface of a work holder plate adapted to be rotated about its axis, such that the workpieces are arranged around the axis of rotation of the work holder plate. In this type of surface polishing method and apparatus, the axis of rotation of the work holder plate does not lie within the workpiece surface to be polished, so that the problem of the central raised or convexed portion of the polished workpiece surface can be solved. However, the workpiece surface is subjected to a greater amount of stock removal by the abrasive grains at a local circumferential portion thereof which is relatively distant from the axis of rotation of the work holder plate, whereby the polished surface of each workpiece is inclined, resulting in deteriorated geometrical and dimensional accuracies of the polished surface. Further, this type of surface polishing method and apparatus requires the work holder plate which is as sufficiently large as about two or more times the diameter or size of the workpiece, whereby the required size of the polishing plate and that of the surface polishing apparatus are inevitably increased, leading to an increased cost of manufacture of the apparatus and an accordingly increased cost of polishing operation.

SUMMARY OF THE INVENTION

It is therefore a first object of this invention to provide a surface polishing method which permits even a large-sized workpiece to be polished with a high degree of flatness, with a relatively small-sized apparatus.

A second object of the invention is to provide a relatively small-sized surface polishing apparatus suitable for practicing the method of the invention.

The first object may be achieved according to a first aspect of this invention, which provides a method of polishing a surface of a workpiece in a plane such that the workpiece is held in sliding contact with a polishing face of a rotating polishing plate, the method comprising the steps of: rotating the workpiece about an autorotation axis thereof which is parallel to an axis of rotation of the polishing plate and which lies within the surface of the workpiece; and revolving the autorotation axis of the workpiece about a revolving axis which is parallel to the axis of rotation of the polishing plate and which lies within a circumscribed circle of the surface of the workpiece.

In the surface polishing method of the present invention, the workpiece held in sliding contact with the polishing face of the polishing plate is rotated about its autorotation axis parallel to the axis of rotation of the polishing plate, while at the same time the autorotation axis of the workpiece is revolved about the revolving axis which is parallel to the axis of rotation of the polishing plate and which lies within the circumscribed circle of the workpiece surface. As a result of the revolution of the autorotation axis of the workpiece as well as the autorotation of the workpiece about the autorotation axis, the tendency of formation of a central raised or upwardly convexed portion of the polished surface of the workpiece or inclination of the polished workpiece surface can be minimized to thereby improve the flatness and the geometric and dimensional accuracies of the polished workpiece surface, even when the workpiece is relatively large-sized. Further, since the revolving axis about which the autorotation axis of the workpiece is revolved is located within the circumscribed circle of the workpiece surface, the present method does not require a work holder plate which is as large as two or more time the size (diameter) of the workpiece, making it possible to reduce the sizes of the polishing plate and the surface polishing apparatus used, thereby permitting a significant reduction in the cost of a surface polishing operation and the cost of manufacture of the surface polishing apparatus.

In one preferred form of the present method, the rotation of the polishing plate about the axis of rotation, the autorotation of the workpiece about the autorotation axis and the revolution of the autorotation axis of the workpiece about the revolving axis take place in the same direction. In this arrangement, the difference in the polishing speed of the workpiece at a relatively radially inner portion and a relatively radially outer portion of the polishing face of the polishing plate is reduced, resulting in an improvement in the flatness of the polished surface of the workpiece.

In another preferred form of the method, the workpiece is rotated about the autorotation axis with a rotating period $T_A$ while the autorotation axis is revolved about the revolving axis with a revolving period $T_B$, so as to satisfy $0.1 \leqq T_B/T_A < 1$, or $1 < T_B/T_A \leqq 10$, namely, $0.1 \leqq T_B/T_A \leqq 10$, and $T_A/T_B \neq 1$, more preferably, so as to satisfy $0.8 \leqq T_B/T_A < 1$, or $1<T_B/T_A \leqq 1.25$, namely, $0.8 \leqq T_B/T_A \leqq 1.25$, and $T_A/T_B \neq 1$. In this case, the rotating period $T_A$ and the revolving period $T_B$ are made different from each other so as to assure a sufficiently high degree of flatness of the polished workpiece surface.

In a further preferred form of the method, a radius of an orbit of the autorotation axis of the workpiece about the revolving axis is not smaller than 5% of a radius of an inscribed circle of the workpiece, and more preferably, the radius of the orbit of the autorotation axis is not smaller than the radius and is not larger than a radius of the circumscribed circle of the workpiece. This arrangement contributes a further improvement in the flatness of the polished workpiece surface.

In a still further preferred form of the method, the polishing face of the polishing plate consists of an annular surface, and the revolving axis of the autorotation axis of the workpiece lies between an inside diameter and an outside diameter of the annular surface of the polishing face. More preferably, the inside diameter of the annular surface of the polishing face is larger than a diameter of an orbit of the autorotation axis of the workpiece. In this arrangement, the autorotation axis of the workpiece is not located radially inwardly of the inner periphery of the annular polishing face of the polishing plate, or radially outwardly of the outer periphery of the annular polishing face, so that the polishing accuracy is maintained at a sufficiently high level. In the present arrangement, the distance of movement of the autorotation axis of the workpiece in the radially inward direction of the polishing plate wheel is smaller than a value corresponding to the inside diameter of the polishing face, thereby preventing any portion of the workpiece surface from moving from one position of the polishing face to another position of the same diametrically opposite to that one position, while moving past the axis of rotation of the polishing face.

The second object indicated above may be achieved according to a second aspect of this invention, which provides a surface polishing apparatus for polishing a surface of a workpiece in a plane such that the workpiece is held in sliding contact with a polishing face of a rotating polishing plate, the surface polishing apparatus comprising: a work rotating device operable to rotate the workpiece about an autorotation axis thereof which is parallel to an axis of rotation of the polishing plate and which lies within the surface of the workpiece; and a work revolving device operable to revolve the autorotation axis of the workpiece about a revolving axis which is parallel to the axis of rotation of the polishing plate and which lies within a circumscribed circle of the surface of the workpiece.

The surface polishing apparatus constructed as described above provides substantially the same advantages as the surface polishing method which has been described.

In one preferred form of the surface polishing apparatus, a wheel rotating device for rotating the polishing plate, and the above-indicated work rotating device and work revolving device are operated such that the rotation of the polishing plate about the axis of rotation, the autorotation of the workpiece about the autorotation axis and the revolution of the autorotation axis of the workpiece about the revolving axis take place in the same direction.

In another preferred form of the apparatus, the work rotating device and the work revolving device are operated such that the workpiece is rotated about the autorotation axis with a rotating period $T_A$ and the autorotation axis is revolved about the revolving axis with a revolving period $T_B$ so as to satisfy $0.1 \leqq T_B/T_A < 1$, or $1 < T_B/T_A \leqq 10$. More preferably, the work rotating device and the work revolving device are operated such that the rotating period $T_A$ and the revolving period $T_B$ satisfy $0.8 \leqq T_B/T_A < 1$, or $1 < T_B/T_A \leqq 1.25$.

In a further preferred form of the apparatus, a radius of an orbit of the autorotation axis of the workpiece about the revolving axis is not smaller than 5% of a radius of an inscribed circle of the workpiece. According to one advantageous arrangement of this form of the apparatus, the radius of the orbit of the autorotation axis is not smaller than the radius and is not larger than a radius of the circumscribed circle of the workpiece.

In a still further preferred form of the surface polishing apparatus, the polishing face of the polishing plate consists of an annular surface, and the revolving axis of the autorotation axis of the workpiece lies between an inside diameter and an outside diameter of the annular surface of the polishing face. In this case, the inside diameter of the annular surface of the polishing face is desirably larger than a diameter of an orbit of the autorotation axis of the workpiece.

BRIEF DESCRIPTION OF THE DRAWINGS

The above and optional objects, features, advantages and technical and industrial significance of this invention will be better understood and appreciated by reading the following detailed description of a presently preferred embodiment of the invention, when considered in connection with the accompanying drawings in which.

DETAILED DESCRIPTION OF THE PREFERRED EMBODIMENT

Figure 1:
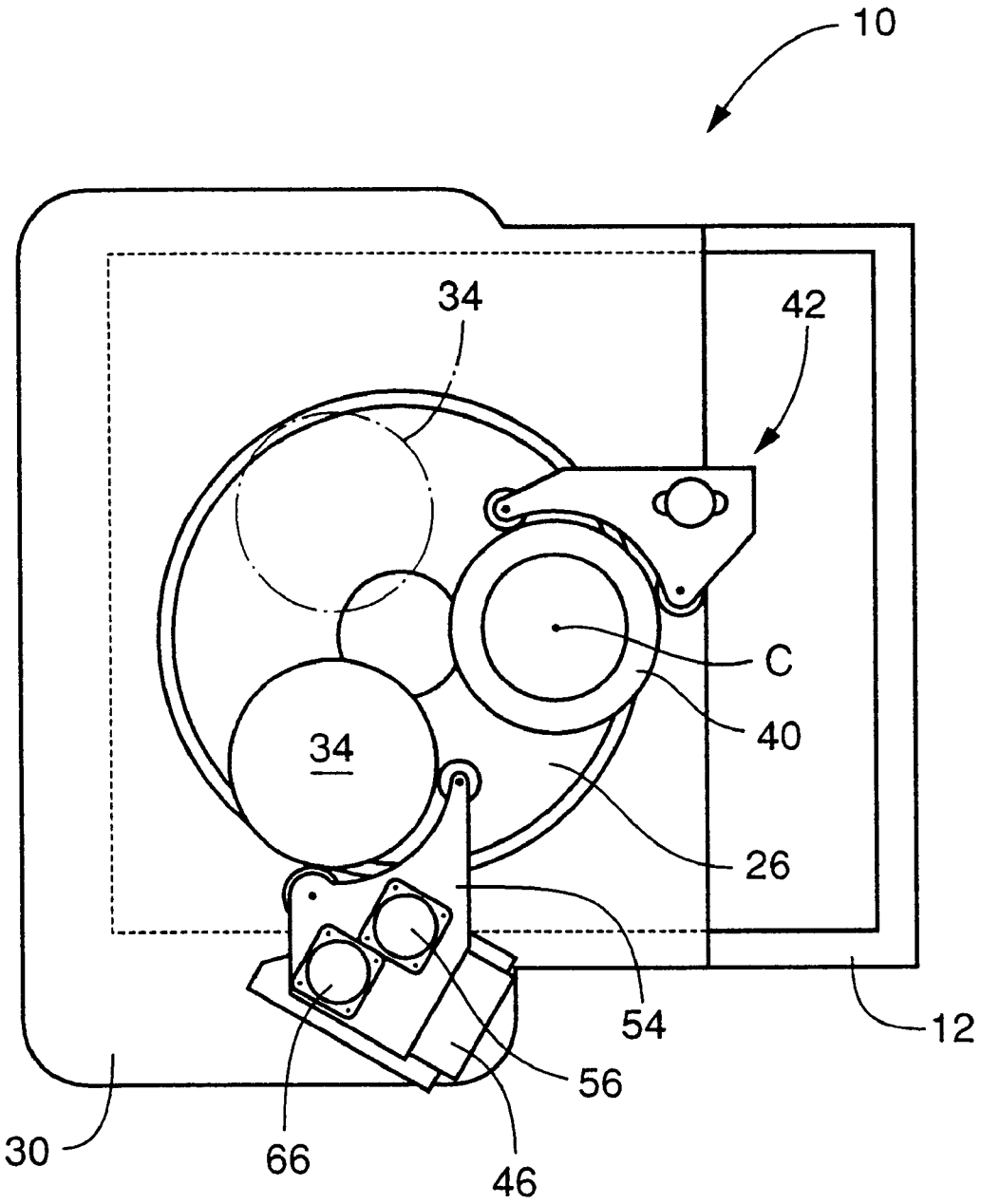
FIG. 1 is a plan view of a surface polishing machine constructed according to one embodiment of this invention.
Figure 2:
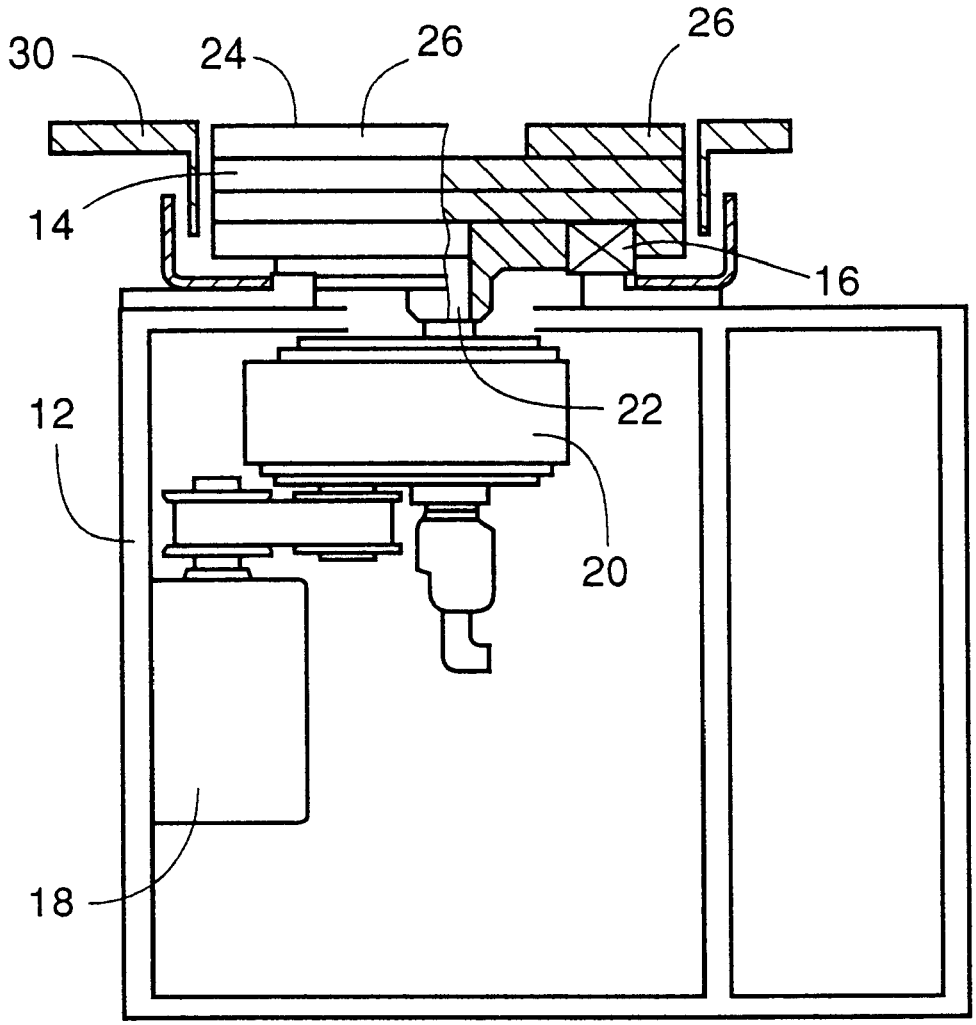
FIG. 2 is a fragmentary front elevational view of the surface polishing machine of FIG. 1.

Referring first to FIGS. 1 and 2, there is shown a surface polishing machine 10 constructed according to one embodiment of the present invention. The surface polishing machine 10 has a frame 12 on which is supported a circular disc 14 via a bearing 16 such that the circular disc 14 is rotatable about an axis thereof which is substantially vertical. The circular disc 14 is rotated by a wheel drive motor 18 via a speed reducing device 20. The speed reducing device 20 is connected to the wheel drive motor 18 through a belt and has a vertically extending output shaft 22 to which the circular disc 14 is connected. To the upper surface of the circular disc 14, there is fixed a polisning plate in the form of a polishing wheel 26 which has a polishing face (lapping face) in the form of a flat annular face 26 having an inside diameter D1 and an outside diameter D2. The flat annular face 24 will be referred to as a polishing face 26. With the polishing wheel 26 fixed to the circular disc 14, the polishing face 26 lies in a plane perpendicular to the axis of rotation of the output shaft 22 of the speed reducing device 20, that is, lies in the horizontal plane. The polishing wheel 26 with the polishing face 24 is rotated by the wheel drive motor 18, in a direction indicated by an arrow in FIG. 3.

The polishing wheel 26 may be formed of a relatively soft metal such as tin or copper, where the surface polishing machine 10 is adapted to effect a polishing operation using loose or free abrasive grains used with a polishing fluid or coolant. Where the surface polishing machine 10 is adapted to effect a polishing operation using fixed abrasive grains, the polishing wheel 26 may be a wheel carrying abrasive grains bonded thereto, as disclosed in JP-A-10-286755.

Figure 3:
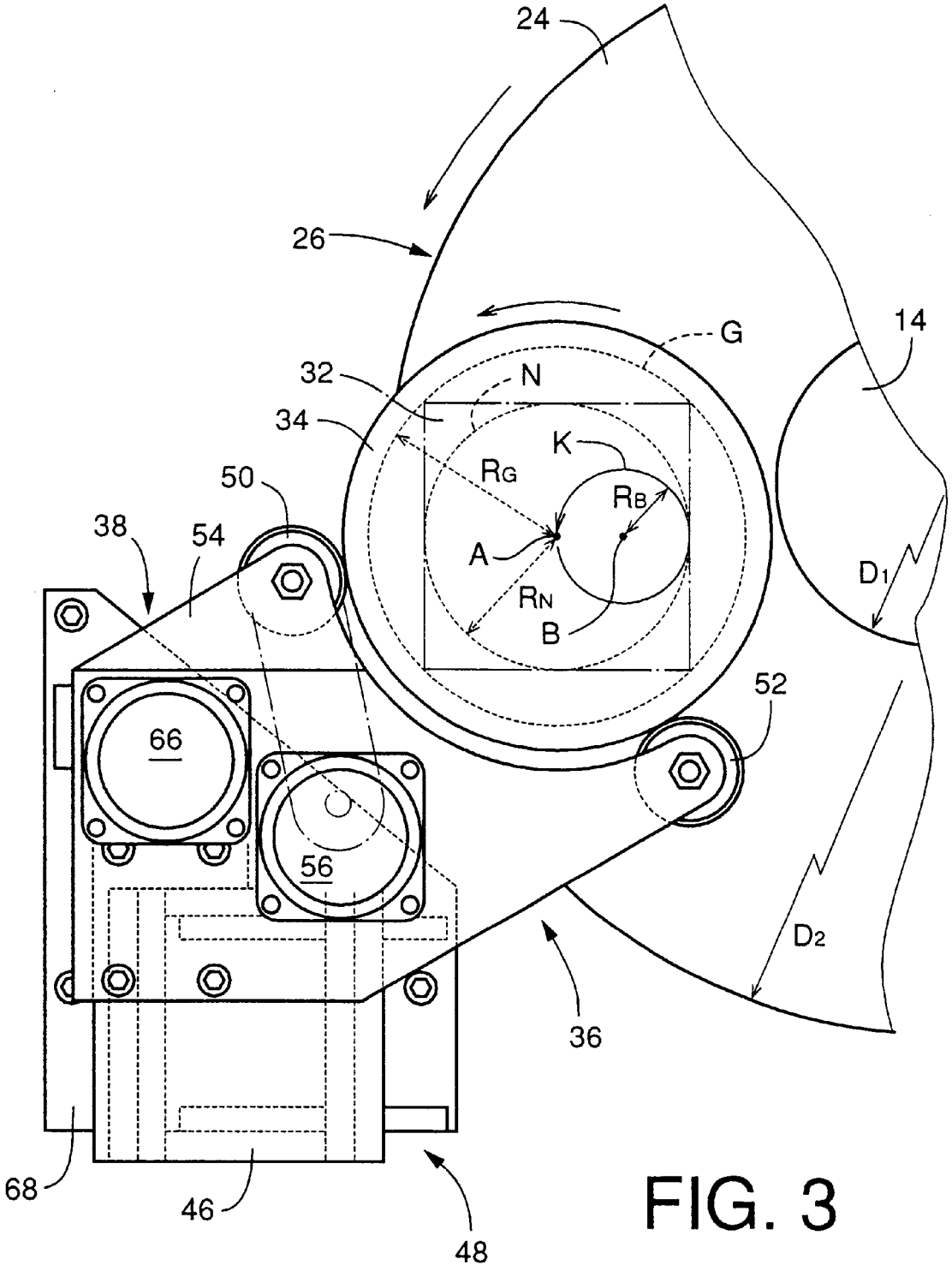
FIG. 3 is a fragmentary enlarged plan view of the surface polishing machine, showing a work rotating device and a work revolving device, and indicating an autorotation axis of a workpiece and an orbit of revolution of the workpiece relative to a polishing wheel.

Around and adjacent to the polishing wheel 26, there are disposed a setup plate 30, a work rotating device 36, a work revolving device 38, and a ring rotating device 42. The setup plate 30 is used for facilitating a setup of the surface polishing machine 10, and for other purposes. The work rotating device 36 is adapted to rotate a work holder member in the form of a circular work holder plate 34 about an autorotation axis A which extends in the vertical direction. The work holder plate 34 has a lower surface to which a workpiece 32 in the form of a rectangular plate is bonded or otherwise fixed by suitable means, as indicated in FIG. 3. The work revolving device 38 is adapted to revolve the autorotation axis A of the work holder plate 34 or workpiece 32 about a revolving axis B which is parallel to the axis A, so that the workpiece 32 is rotated in an orbit K. The ring rotating device 42 is adapted to rotate a rectifying ring 40 having a relatively small axial length. The rectifying ring 40 rotated by the ring rotating device 42 is held in sliding contact with the polishing face 24, during a polishing operation on the workpiece 32 by the polishing wheel 24, so that the entire area of the polishing face 24 is kept flat during the service life of the polishing wheel 26.

It will be understood that the autorotation axis A about which the workpiece 32 is rotated and the revolving axis B about which the autorotation axis A is revolved are parallel to the axis of rotation of the polishing wheel 26. One-dot chain line in FIG. 1 indicates a second work holder plate 34 which carries the workpiece 32 fixed thereto. For this second work holder 34, there are also provided the work rotating device 36 and the work revolving device 38 for rotating the corresponding workpiece 32 about its autorotation axis A and revolving the workpiece about the revolving axis B. It is noted that the work holder plate 34 and the rectifying ring 40 are merely placed on the polishing face 26 by gravity while the work holder plate 34 and the rectifying rig 40 are rotated by the respective rotating devices 36, 42.

Figure 4:
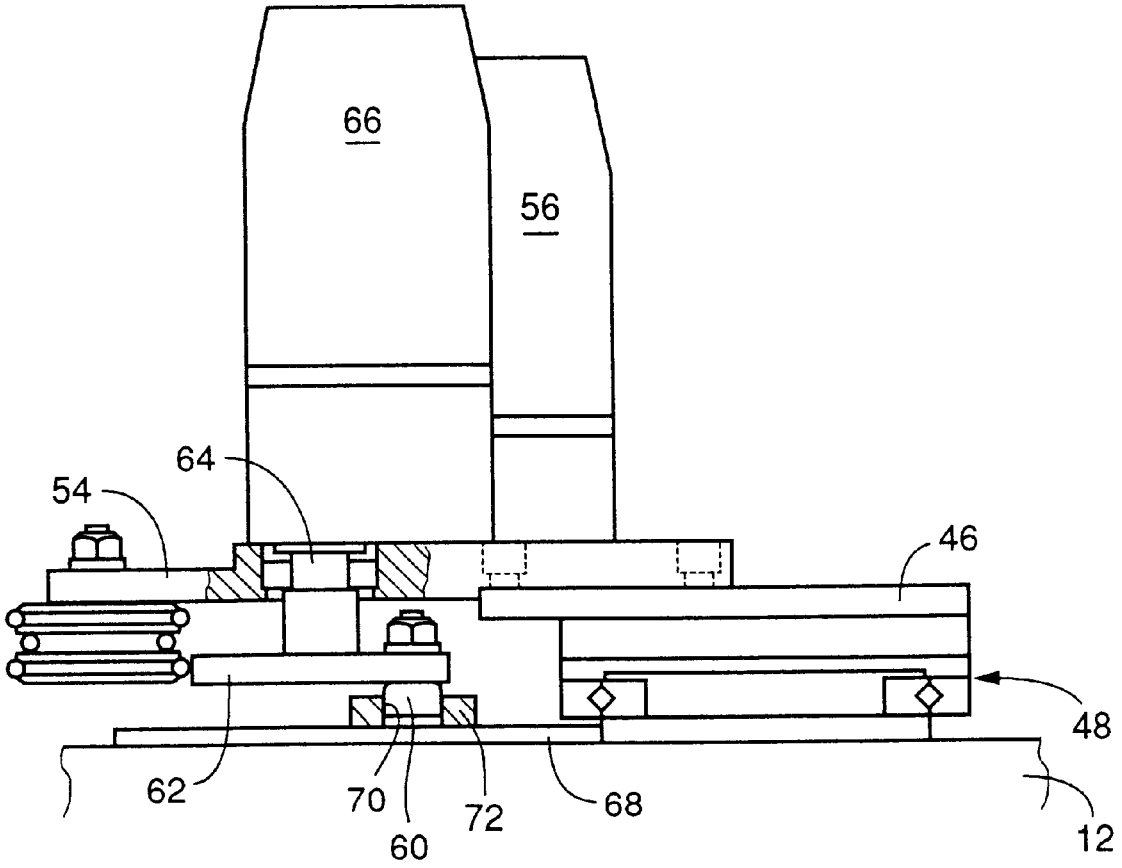
FIG. 4 a side elevational view of the work rotating and revolving devices of the surface polishing machine of FIG. 1.

As shown in FIGS. 3 and 4, a cross roller support 48 is provided on the frame 12. On this cross roller support 48, there is mounted an XY table 46 such that the XY table 46 is movable in mutually perpendicular X and Y directions. The XY table 46 carries an arm member 54 fixed thereto so as to extend generally in the radially inward direction of the circular work holder plate 34 placed on the polishing face 24 of the polishing wheel 26. The arm member 54 has a pair of rollers 50, 52 which are engageable with the outer circumferential surface of the work holder plate 34, as shown in FIG. 3. On the arm member 54, there is mounted a work rotating motor 56 for rotating the roller 50 to rotate the work holder plate 34 in a direction indicated by an arrow in FIG. 3, which direction is the same as the direction of rotation of the polishing wheel 26 also indicated by an arrow in FIG. 3. It will be understood that the arm member 54 having the rollers 50, 52 cooperates with the work rotating motor 56 to constitute the above-indicated work rotating device 36 for rotating the work holder plate 34 together with the workpiece 32 fixed to its lower surface, about an autorotation axis A which extends in the vertical direction and which is parallel to the axis of rotation of the polishing wheel 26.

A work revolving motor 66 is also mounted on the arm member 54 such that an output shaft 64 of the motor 66 extends downwards. The output shaft 64 carries a circular disc 62 fixed at its lower end. The circular disc 62 has a small-diameter roller 60 fixed at a position thereof radially distant from its center (axis of the output shaft 64). A plate 68, which is fixed to the frame 12, has an engaging hole 70 located below the circular disc 62. The small-diameter roller 60 extending downwards from the circular disc 62 engages the engaging hole 70 so that movements of the small-diameter roller 60 in the X and Y directions are prevented by the engaging hole 70. In this arrangement, an operation of the work revolving motor 66 causes the arm member 54 to have a circular motion in the X and Y directions, along a circle which has a center on the centerline of the small-diameter roller 60 and a radius D which is a distance between the axis of rotation of the output shaft 64 (the center of the circular disc 62) and the centerline of the small-diameter roller 60. As a result, the arm member 54 whose rollers 50, 52 engaging the outer circumferential surface of the circular work holder plate 34 revolves the work holder plate 34 such that the autorotation axis A of the work holder plate 34 (workpiece 32) is rotated about the revolving axis B in the orbit K in the same direction as the direction of rotation of the polishing wheel 26, as indicated an arrow in FIG. 3. Thus, the workpiece 32 fixed to the lower surface of the work holder plate 34 is revolved about the revolving axis B. It will be understood that the circular plate 62 having the small-diameter roller 70, the work revolving motor 66 and the engaging member 72 cooperate to constitute the above-indicated work revolving device 38 for revolving the autorotation axis A of the workpiece 32 about the revolving axis B.

In operation of the surface polishing machine 10, the work rotating device 36 and the work revolving device 38 are operated such that the workpiece 32 is rotated about the autorotation axis A with a rotating period $T_A$ while the autorotation axis A of the workpiece 32 fixed to the work holder plate 34 is revolved about the revolving axis B with a revolving period $T_B$, so as to satisfy $0.1 \leqq T_B/T_A < 1$, or $1 < T_B/T_A \leqq 10$, namely, $0.1 \leqq T_B/T_A \leqq 10$, and $T_A/T_B \neq 1$, more preferably, so as to satisfy $0.8 \leqq T_B/T_A < 1$, or $1 < T_B/T_A \leqq 1.25$, namely, $0.8 \leqq T_B/T_A \leqq 1.25$, and $T_A/T_B \neq 1$.

The autorotation axis A of the workpiece 32 is located at the center of an inscribed circle N of the workpiece 32. The orbit K in which the autorotation axis A is rotated about the revolving axis B has a radius $R_B$ not smaller than 5% of a radius $R_N$ of the inscribed circle N. More preferably, the radius $R_B$ of the orbit K is not smaller than 5% of the radius $R_N$ of the inscribed circle and is not larger than a radius $R_G$ of a circumscribed circle G of the workpiece 32. Further, the revolving axis B lies between the inside diameter D1 and the outside diameter D2 of the annular polishing face 24 of the polishing wheel 26, and the inside diameter D1 is larger than a diameter $2R_B$ of the orbit K of the autorotation axis A of the workpiece 32.

An operation of the surface polishing machine 10 constructed as described above will be described. Initially, the polishing wheel 26 is rotated, and a polishing fluid is supplied onto the polishing wheel 26. The polishing fluid or slurry may contain loose or free abrasive grains, as needed. Then, the rectifying ring 40 is placed on the polishing face 24, and is rotated by the ring rotating device 42 in the same direction as the polishing wheel 26. Further, the work holder plate 34 carrying the workpiece 32 bonded or otherwise fixed to its lower surface is placed on the polishing face 26, and is rotated by the work rotating device 36 about the autorotation axis A, in the same direction as the polishing wheel 26. At the same time, the workpiece 32 is revolved by the work revolving device 38 such that the autorotation axis A of the workpiece 32 is rotated about the revolving axis B, in the same direction as the direction of rotation of the polishing wheel 26. The work rotating device 36, the work revolving device 38 and the ring rotating device 42 are kept operated for a suitable length of time while the polishing wheel 26 is being rotated. As a result, the surface of the workpiece contacting the polishing face 24 is polished, lapped or ground.

As described above, the surface polishing machine 10 according to the present embodiment of this invention is constructed such that the workpiece 32 held in sliding contact with the polishing face 24 of the rotated polishing wheel 26 is rotated by the work rotating device 36 about its autorotation axis A which is parallel to the axis of rotation of the polishing wheel 26 and which lies within the surface of the workpiece 32 to be polished. At the same time, the workpiece 32 is revolved by the work revolving device 38 about the revolving axis B which is parallel to the axis of rotation of the polishing wheel 26 and which lies within the circumscribed circle G of the workpiece 32. As a result of the revolution of the autorotation axis A of the workpiece 32 about the revolving axis B as well as the autorotation of the workpiece 32 about the autorotation axis A, the tendency of formation of a central raised or upwardly convexed portion of the polished surface of the workpiece 32 or inclination of the polished workpiece surface can be minimized to thereby improve the flatness and the geometric and dimensional accuracies of the polished workpiece surface, even when the workpiece 32 is relatively large-sized. Further, since the revolving axis B about which the autorotation axis A of the workpiece 32 is revolved is located within the circumscribed circle G of the workpiece surface, the present polishing apparatus and method do not require the work holder plate 34 to be as large as two or more time the size of the workpiece 32, making it possible to reduce the sizes of the polishing wheel 26 and the surface polishing machine 10, thereby permitting a significant reduction in the cost of the surface polishing operation and the cost of manufacture of the polishing machine 10.

In addition, the work rotating device 36 and the work revolving device 38 are operated in the present embodiment such that the workpiece 32 is rotated about the autorotation axis A with a rotating period $T_A$ while the autorotation axis A of the workpiece 32 fixed to the work holder plate 34 is revolved about the revolving axis B with a revolving period $T_B$, so as to satisfy $0.1 \leqq T_B/T_A < 1$, or $1 < T_B/T_A \leqq 10$, namely, $0.1 \leqq T_B/T_A \leqq 10$, and $T_A/T_B \neq 1$, more preferably, so as to satisfy $0.8 \leqq T_B/T_A < 1$, or $1 < T_B/T_A \leqq 1.25$, namely, $0.8 \leqq T_B/T_A \leqq 1.25$, and $T_A/T_B \neq 1$. In this case, the rotating period $T_A$ and the revolving period $T_B$ are made different from each other, so as to assure a sufficiently high degree of flatness of the polished workpiece surface.

The present embodiment is further arranged such that the radius $R_B$ of the orbit K of the autorotation axis A of the workpiece 32 about the revolving axis B is not smaller than 5% of the radius $R_N$ of the inscribed circle N of the workpiece 32, and more preferably, the radius $R_B$ of the orbit K of the workpiece 32 is not smaller than the radius $R_N$ and is not larger than the radius $R_G$ of the circumscribed circle G of the workpiece 32. This arrangement contributes a further improvement in the flatness of the polished workpiece surface.

Further, the present embodiment is arranged such that the polishing face 24 of the polishing wheel 26 consists of an annular surface, and the revolving axis B of the autorotation axis A of the workpiece 32 lies between the inside diameter D1 and the outside diameter D2 of the annular surface of the polishing face 24. In this arrangement, the autorotation axis A of the workpiece 32 is not located radially inwardly of the inner periphery of the annular polishing face 24 of the polishing wheel 26, or radially outwardly of the outer periphery of the annular polishing face 24, so that the polishing accuracy is maintained at a sufficiently high level. In the present arrangement, the distance of movement of the autorotation axis A of the workpiece 32 in the radially inward direction of the polishing wheel is smaller than a value corresponding to the inside diameter D1 of the polishing face, thereby preventing any portion of the workpiece surface from moving from one position of the polishing face 24 to another position of the same diametrically opposite to that one position, while moving past the axis of rotation of the polishing face 24.

Figure 5A:
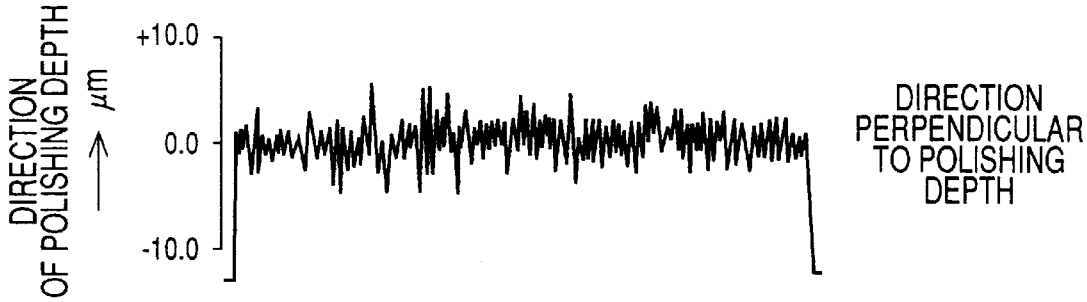
FIGS. 5A and 5B are graphs respectively showing conditions of a surface of the workpiece before and after the surface is polished by a conventional surface polishing machine wherein the workpiece is rotated and reciprocated in a diametric direction of the polishing wheel.
Figure 5B:
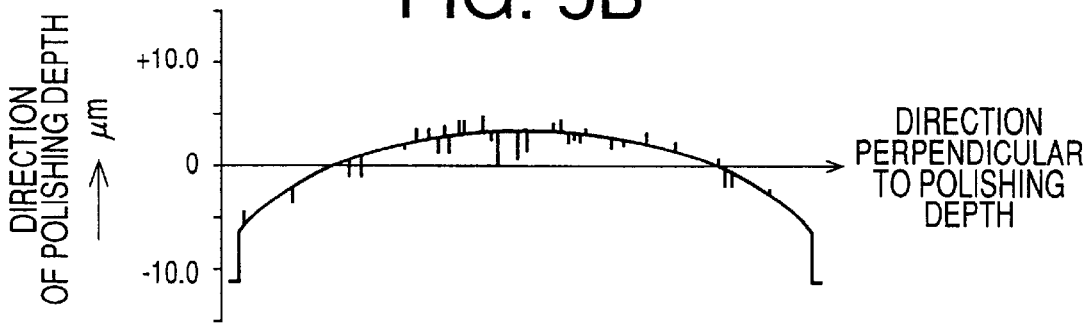
Figure 6A:
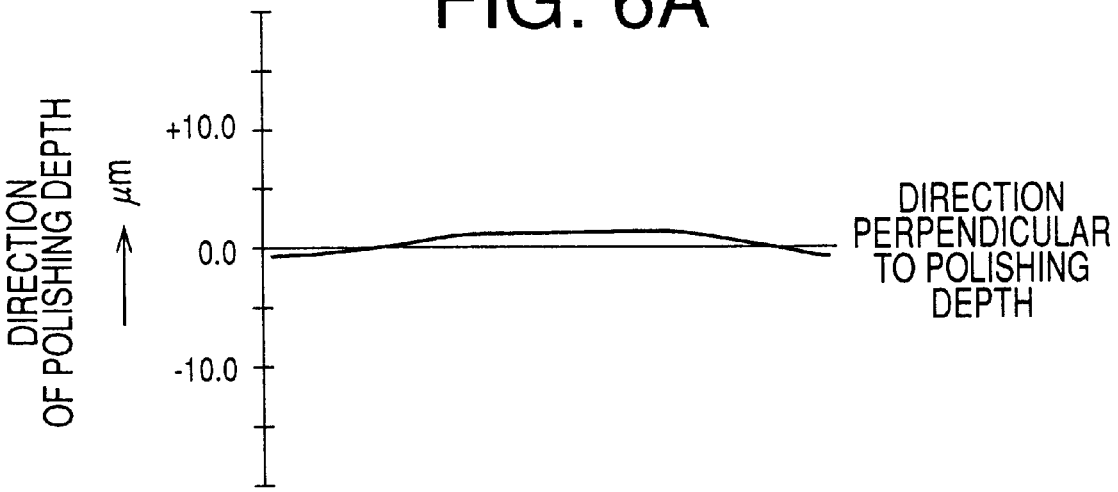
FIGS. 6A and 6B are graphs respectively showing conditions of a surface of the workpiece 32 before and after the surface is polished by the surface polishing machine of FIG. 1 wherein the workpiece 32 is rotated about its autorotation while the autorotation axis is revolved, according to the principle of the present invention.
Figure 6B:
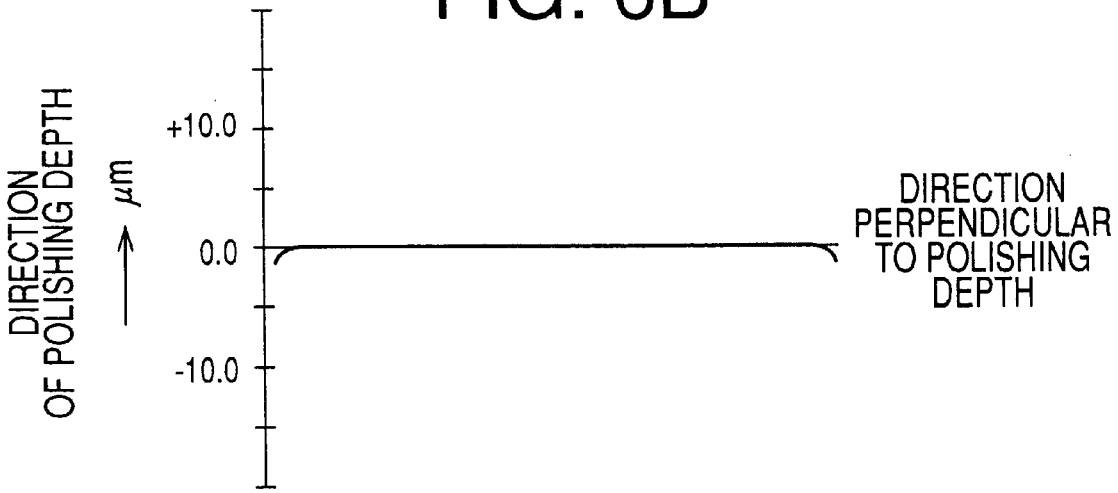

FIGS. 5A and 5B respectively show a condition of a surface of a workpiece before the workpiece surface is polished on a conventional surface polishing machine while the workpiece 32 is rotated about an autorotation axis and reciprocated in a diametric direction of the polishing wheel 26, and a condition of the workpiece surface after the workpiece surface has been polished. FIGS. 6A and 6B respectively show a condition of a surface of the workpiece 32 before the workpiece surface is polished on the present surface polishing machine 10 while the workpiece 32 is rotated about its autorotation axis A and is revolved about the revolving axis B, and a condition of the workpiece surface after the workpiece surface has been polished. It will be understood that although the workpiece surface polished on the conventional surface polishing machine suffers from a raised or upwardly convexed central portion, the workpiece surface polished on the present surface polishing machine 10 according to the principle of the present invention is free from such an upwardly convex central portion, owing to the revolution of the workpiece 32 about the revolving axis B.

While the presently preferred embodiment of this invention has been described above, it is to be understood that the present invention may be otherwise embodied.

For instance, the workpiece which has a rectangular shape in the illustrated embodiment may have a circular or any other shape.

Although the work revolving device 38 uses the electric motor 56 and a mechanism including the disc 62 and the stationary roller 60 for revolving the autorotation axis A about the axis B, the surface polishing machine may employ any other device for creating a circular or elliptical orbital motion of the workpiece 32. For example, the orbital motion may be created by a combination of two or more motions provided by a plurality of reciprocating actuators such as pneumatically or hydraulically operated cylinders.

In the illustrated embodiment, the autorotation of the workpiece 32 by the work rotating device 36 and the revolution of the workpiece 32 about the revolving axis B by the work revolving device 38 take place in the same direction as the rotation of the polishing wheel 26. Where a difference in the peripheral speed of the polishing wheel 26 at its radially inner and outer portions does not matter, however, the autorotation of the workpiece 32 and/or the revolution of the autorotation axis A need not take place in the direction in which the polishing wheel 26 is rotated.

While the workpiece 32 is bonded to the lower surface of the work holder plate 34 in the illustrated embodiment, the work holder plate 34 may have a suitable structure for holding the workpiece 32, for instance, a recess in which the workpiece 32 is fixedly accommodated. Although the workpiece 32 is held in contact with the polishing face 24 of the polishing wheel 26 by gravity due to its own weight and the weight of the work holder plate 34, in the illustrated embodiment, a suitable additional weight may be placed on the work holder plate 34 for applying an additional load to the workpiece 32 during a polishing operation.

It is to be understood that the present invention may be made with various other changes and modifications which may occur to those skilled in the art, without departing from the spirit and scope of the present invention defined by the following claims:

What is claimed is:

1. A method of polishing a surface of a workpiece in a plane such that the surface of the workpiece is held in sliding contact with a polishing face of a rotating polishing plate, said method comprising the steps of:

rotating said workpiece about an autorotation axis thereof which is parallel to an axis of rotation of said polishing plate and which lies within said surface of the workpiece; and revolving said autorotation axis of said workpiece about a revolving axis which is parallel to said axis of rotation of said polishing plate and which lies within a circumscribed circle of said surface of the workpiece, and wherein said workpiece is rotated with a rotating period $T_A$ while said autorotation axis is revolved with a revolving period $T_B$, such that said rotating period $T_A$ and said revolving period $T_B$ satisfies $0.1 \leqq T_B/T_A < 1$, or $1 < T_B/T_A \leqq 10$.

2. A method according to claim 1, wherein the rotation of said polishing plate about said axis of rotation, the autorotation of said workpiece about said autorotation axis and the revolution of said autorotation axis of said workpiece about said revolving axis take place in the same direction.

3. A method according to claim 1, wherein said workpiece is rotated about said autorotation axis with a rotating period $T_A$ and said autorotation axis is revolved about said revolving axis with a revolving period $T_B$ so as to satisfy $0.1 \leqq T_B/T_A < 1$, or $1 < T_B/T_A \leqq 10$.

4. A method according to claim 1, wherein said rotating period $T_A$ and said revolving period $T_B$ are determined so as to satisfy $0.8 \leqq T_B/T_A < 1$, or $1 < T_B/T_A \leqq 1.25$.

5. A method according to claim 1, wherein a radius of an orbit of said autorotation axis of said workpiece about said revolving axis is not smaller than 5% of a radius of an inscribed circle of said workpiece.

6. A method according to claim 5, wherein said radius of the orbit of said autorotation axis is not smaller than said radius of said inscribed circle and is not larger than a radius of said circumscribed circle of said workpiece.

7. A method according to claim 1, wherein said polishing face of said polishing plate consists of an annular surface, and said revolving axis of said autorotation axis of said workpiece lies between an inside diameter and an outside diameter of said annular surface of said polishing face.

8. A method according to claim 7, wherein said inside diameter of said annular surface of said polishing face is larger than a diameter of an orbit (K) of said autorotation axis of said workpiece.

9. A surface polishing apparatus for polishing a surface of a workpiece in a plane such that the surface of the workpiece is held in sliding contact with a polishing face of a rotating polishing plate, said surface polishing apparatus comprising:

a work rotating device operable to rotate said workpiece about an autorotation axis thereof which is parallel to an axis of rotation of said polishing plate and which lies within said surface of the workpiece; and a work revolving device operable to rotate said autorotation axis of said workpiece about a revolving axis which is parallel to said axis of rotation of said polishing plate and which lies within a circumscribed circle of said surface of the workpiece, and wherein said work rotating device rotates said workpiece with a rotating period $T_A$ while the work revolving device revolves said autorotation axis with a revolving period $T_B$, such that said rotating period $T_A$ and said revolving period $T_B$ satisfies $0.1 \leqq T_B/T_A < 1$, or $1 < T_B/T_A \leqq 10$.

10. A surface polishing apparatus according to claim 9, further comprising a wheel rotating device for rotating said polishing plate, and wherein said wheel rotating device, said work rotating device and said work revolving device are operated such that the rotation of said polishing plate about said axis of rotation, the autorotation of said workpiece about said autorotation axis and the revolution of said autorotation axis of said workpiece about said revolving axis take place in the same direction.

11. A surface polishing apparatus according to claim 9, wherein said work rotating device and said work revolving device are operated such that said workpiece is rotated about said autorotation axis with a rotating period $T_A$ and said autorotation axis is revolved about said revolving axis with a revolving period $T_B$ so as to satisfy $0.1 \leqq T_B/T_A < 1$, or $1 < T_B/T_A \leqq 10$.

12. A surface polishing apparatus according to claim 9, wherein said work rotating device and said work revolving device are operated such that said rotating period $T_A$ and said revolving period $T_B$ satisfy $0.8 \leqq T_B/T_A < 1$, or $1 < T_B/T_A \leqq 1.25$.

13. A surface polishing apparatus according to claim 9, wherein a radius of an orbit of said autorotation axis of said workpiece about said revolving axis is not smaller than 5% of a radius of an inscribed circle of said workpiece.

14. A surface polishing apparatus according to claim 13, wherein said radius of the orbit of said autorotation axis is not smaller than said radius of said inscribed circle and is not larger than a radius of said circumscribed circle of said workpiece.

15. A surface polishing apparatus according to claim 9, wherein said polishing face of said polishing plate consists of an annular surface, and said revolving axis of said autorotation axis of said workpiece lies between an inside diameter and an outside diameter of said annular surface of said polishing face.

16. A surface polishing apparatus according to claim 15, wherein said inside diameter of said annular surface of said polishing face is larger than a diameter of an orbit of said autorotation axis of said workpiece.

17. A method of polishing a surface of a workpiece in a plane such that the surface of the workpiece is held in sliding contact with a polishing face of a rotating polishing plate, said method comprising the steps of:

rotating said workpiece about an autorotation axis thereof which is parallel to an axis of rotation of said polishing plate and which lies within said surface of the workpiece; and revolving said autorotation axis of said workpiece about a revolving axis which is parallel to said axis of rotation of said polishing plate and which lies within a circumscribed circle of said surface of the workpiece, and wherein the rotation of said polishing plate about said axis of rotation, the autorotation of said workpiece about said autorotation axis and the revolution of said autorotation axis of said workpiece about said revolving axis take place in the same direction.

18. A method of polishing a surface of a workpiece in a plane such that the surface of the workpiece is held in sliding contact with a polishing face of a rotating polishing plate, said method comprising the steps of:

rotating said workpiece about an autorotation axis thereof which is parallel to an axis of rotation of said polishing plate and which lies within said surface of the workpiece; and revolving said autorotation axis of said workpiece about a revolving axis which is parallel to said axis of rotation of said polishing plate and which lies within a circumscribed circle of said surface of the workpiece, and wherein said workpiece is rotated about said autorotation axis with a rotating period $T_A$ by a work rotating device including a first drive source, while said autorotation axis of said workpiece is revolved about said revolving axis with a revolving period $T_B$ by a work revolving device including a second drive source, said first and second drive sources being operable independently of each other such that a ratio $T_B/T_A$ is controllable.

19. A surface polishing apparatus for polishing a surface of a workpiece in a plane such that the surface of the workpiece is held in sliding contact with a polishing face of a rotating polishing plate, said surface polishing apparatus comprising:

a wheel rotating device for rotating said polishing plate;

a work rotating device operable to rotate said workpiece about an autorotation axis thereof which is parallel to an axis of rotation of said polishing plate and which lies within said surface of the workpiece;

a work revolving device operable to rotate said autorotation axis of said workpiece about a revolving axis which is parallel to said axis of rotation of said polishing plate and which lies within a circumscribed circle of said surface of the workpiece, and wherein said wheel rotating device, said work rotating device and said work revolving device are operated such that the rotation of said polishing plate about said axis of rotation, the autorotation of said workpiece about said autorotation axis and the revolution of said autorotation axis of said workpiece about said revolving axis take place in the same direction.

20. A surface polishing apparatus for polishing a surface of a workpiece in a plane such that the surface of the workpiece is held in sliding contact with a polishing face of a rotating polishing plate, said surface polishing apparatus comprising:

a work rotating device operable to rotate said workpiece about an autorotation axis thereof which is parallel to an axis of rotation of said polishing plate and which lies within said surface of the workpiece; and a work revolving device operable to rotate said autorotation axis of said workpiece about a revolving axis which is parallel to said axis of rotation of said polishing plate and which lies within a circumscribed circle of said surface of the workpiece, and wherein said work rotating device includes a first drive source for rotating said workpiece about said autorotation axis with a rotating period $T_A$, while a second drive source for revolving said autorotation axis with a revolving period $T_B$, said first and second drive sources being operable independently of each other such that a ratio $T_B/T_A$ is controllable.

* * * * *